US005501400A

United States Patent [19]

Kuo

[11] Patent Number: 5,501,400

[45] Date of Patent: Mar. 26, 1996

[54] WATER SPRAY GUN

[76] Inventor: Awdu Kuo, No. 10, Fang Tsung Road, Wen Chien Tsun, Fang Yuan Hisnag, Changhua Hsien, Taiwan

[21] Appl. No.: 287,885

[22] Filed: Aug. 9, 1994

[51] Int. Cl.[6] ..... B05B 1/12; B05B 1/16

[52] U.S. Cl. ..... 239/394; 239/525; 239/601; 239/574

[58] Field of Search ..... 239/526, 390, 239/394, 525, 589, 601, 597, 588, 574

[56] References Cited

U.S. PATENT DOCUMENTS

| | | | |
|---|---|---|---|
| 3,697,313 | 10/1972 | Stumphauzer et al. | 239/601 X |
| 3,982,698 | 9/1976 | Anderson | 239/394 |
| 4,534,512 | 8/1985 | Chow et al. | 239/394 |
| 4,666,085 | 5/1987 | Liaw | 239/520 X |
| 4,682,734 | 7/1987 | Proctor et al. | 239/394 X |

FOREIGN PATENT DOCUMENTS

| | | | |
|---|---|---|---|
| 287203 | 6/1914 | Germany | 239/394 |
| 2155075 | 5/1973 | Germany | 239/394 |
| 1441841 | 12/1973 | United Kingdom | 239/394 |

*Primary Examiner*—Kevin P. Weldon
*Attorney, Agent, or Firm*—Bacon & Thomas

[57] ABSTRACT

A water spray gun including a plurality of small holes extending through an annular recess on the inside of the spray-pattern dial and around the border of the dial for producing a broad spray of fine drops of water. One nozzle on the spray-pattern dial has a 45° sector-like through hole for producing a smooth downward flow of water for watering plants without changing the holding position of the spray gun. A spring-supported locating rod is received in a radial recessed hole on a housing to hold the spray-pattern dial in the selected spray-pattern position, and a control lever locking device having side projections for operation by the thumb is provided to lock the control lever in the depressed position.

4 Claims, 4 Drawing Sheets

WATER SPRAY GUN

BACKGROUND OF THE INVENTION

The present invention relates to water spray guns, and relates to an improved structure of water spray gun which can be accurately retained in the selected spray-pattern position and, which can produce a broad spray of fine drops of water.

Various water spray guns are well known and intensively used to water plants. FIG. 1 shows a prior art water spray gun which comprises a housing, a spray-pattern dial mounted on the front water outlet of the housing, a control lever controlled to draw water out of the housing through the spray-pattern dial. The spray-pattern dial has a plurality of nozzles in different patterns turned to alternatively align with the water outlet of the housing for producing a respective patter of water spray. As the diameter of the nozzles are approximately equal to the water outlet of the housing, water pressure cannot be reduced when a spray of water is drawn out of either nozzle thereby, causing slender leaves of plants to be damaged. Another drawback of this structure of water spray gun is that each nozzle covers only a limited area because their diameters are approximately equal to the water outlet of the housing, a small part of the diameter of the spray-pattern dial. Still another drawback of this structure of water spray gun is that the spray-pattern dial may displace easily after either nozzle has been set in alignment with the water outlet of the housing. A yet further drawback of this structure of water spray gun is that the triangular locking device for locking the control lever in the depressed position is difficult to operate.

SUMMARY OF THE INVENTION

According to one aspect of the present invention, the spray-pattern dial of the water spray gun can be adjusted so as to reduce the output water pressure.

According to another aspect of the present invention, the spray-pattern dial of the water spray gun has a plurality of through holes through an annular groove around the border for producing fine drops of water which cover a broad area.

According to still another aspect of the present invention, the spray-pattern dial includes a nozzle defining a 45° sector-like through hole for letting water be drawn out of the spray gun for watering plants.

According to still another aspect of the present invention, the housing of the water spray gun has a spring-supported locating rod received in a side hole thereof and engaged into either of a series of locating grooves around the inside wall of the spray-pattern dial to hold down the spray-pattern dial in the selected position, thus permitting the selected spray-pattern nozzle to be firmly retained in alignment with the water outlet of the housing.

According to still another aspect of the present invention, the locking device for locking the control lever in the depressed position has two opposite side projections which can be conveniently depressed by the thumb causing the locking device to lock the control lever in the depressed position when the control lever is operated by the hand.

DETAILED DESCRIPTION OF THE PREFERRED EMBODIMENT

Figure 1:
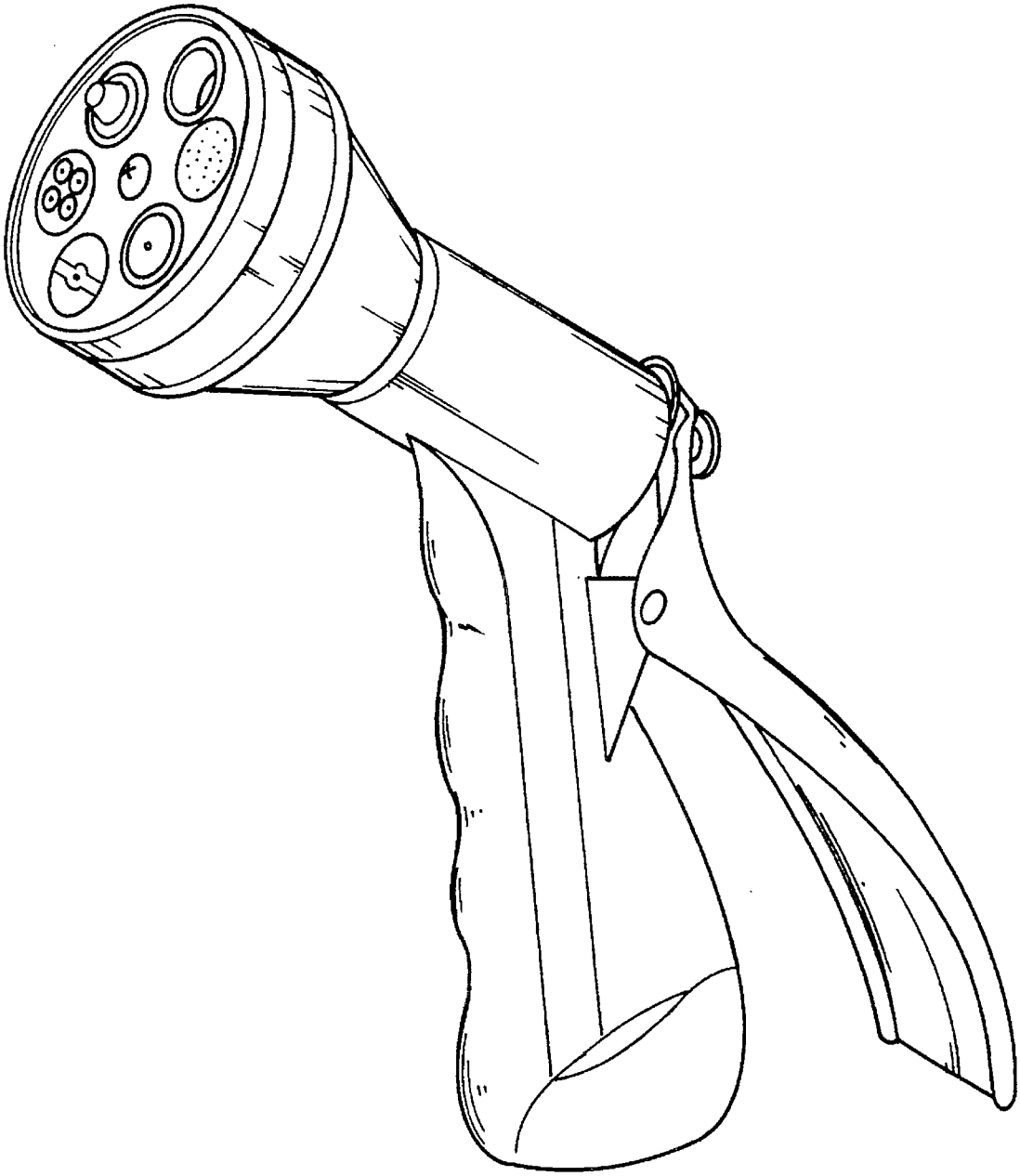
Fig.1 PRIOR ART
FIG. 1 is an elevational view of a water spray gun according to the prior art.
Figure 2A:
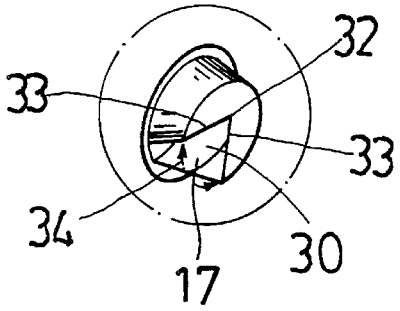
FIG. 2A shows a nozzle defining a 45° sector-like through hole for letting water to pass according to the present invention.
Figure 2:
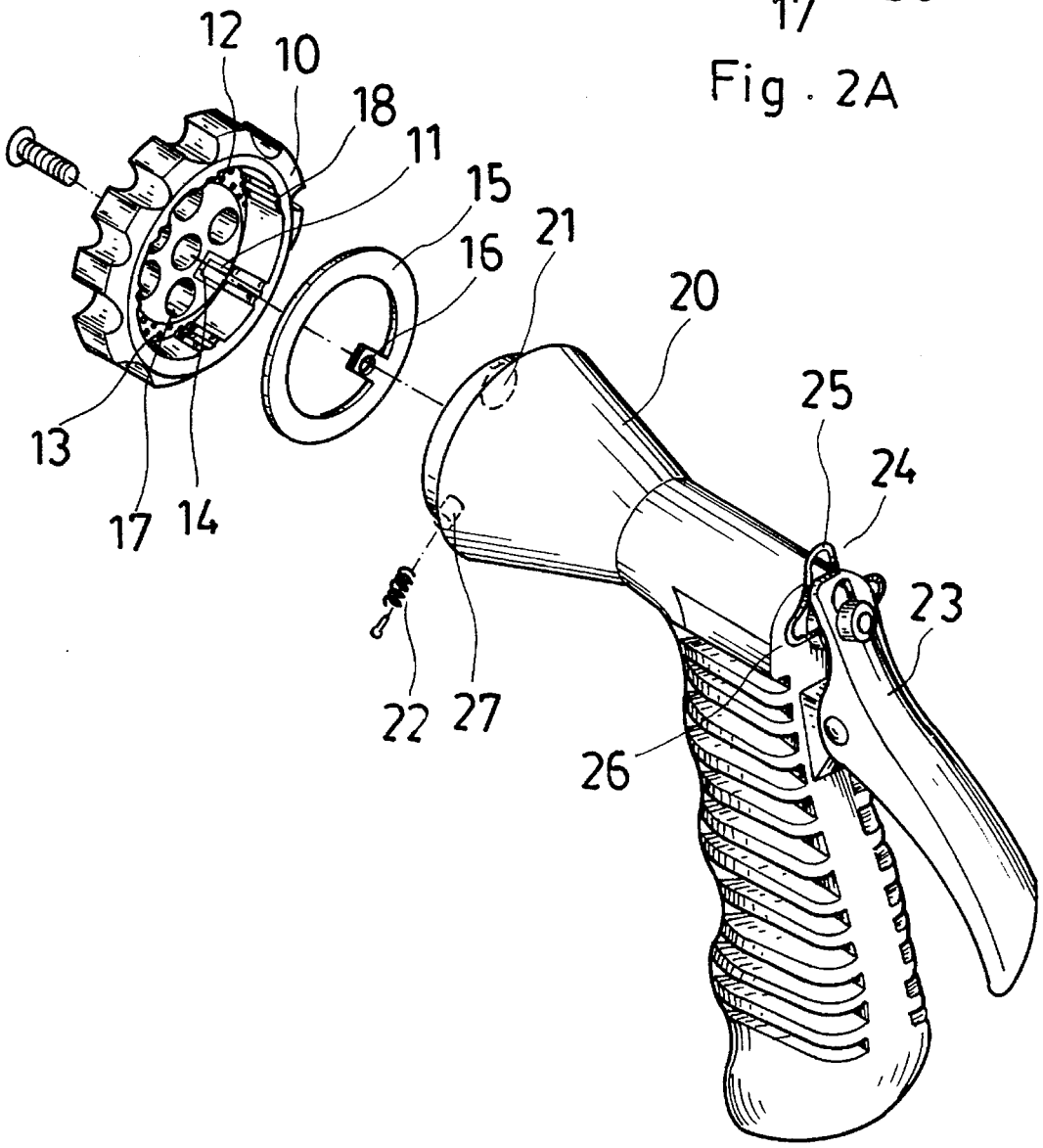
FIG. 2 is an exploded view of a water spray gun according to the present invention.
Figure 3:
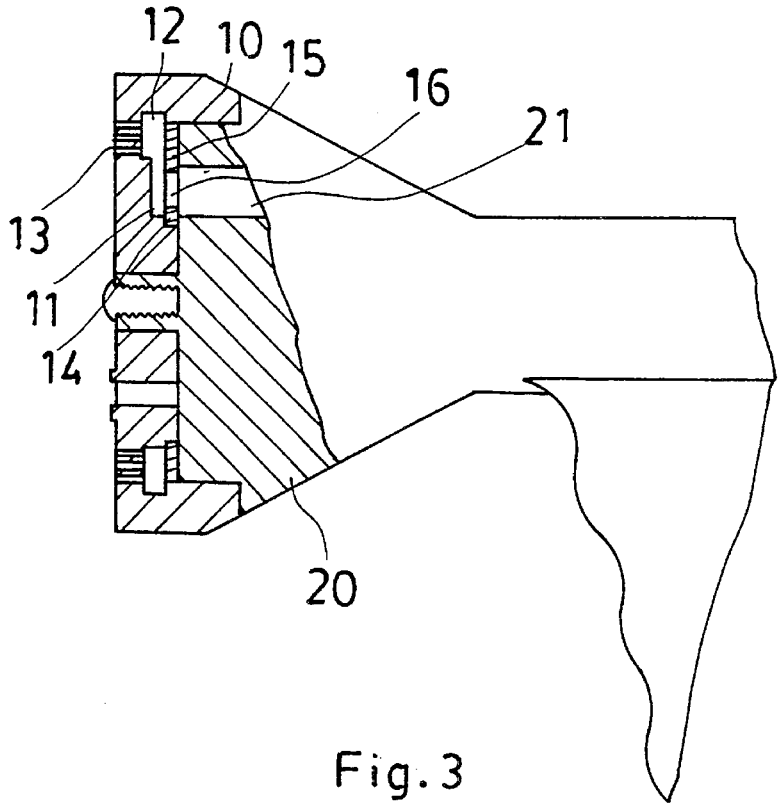
FIG. 3 is a partial view in section of the water spray gun shown in FIG. 2, showing the water outlet of the housing aligned with the through hole on the packing ring.
Figure 4:
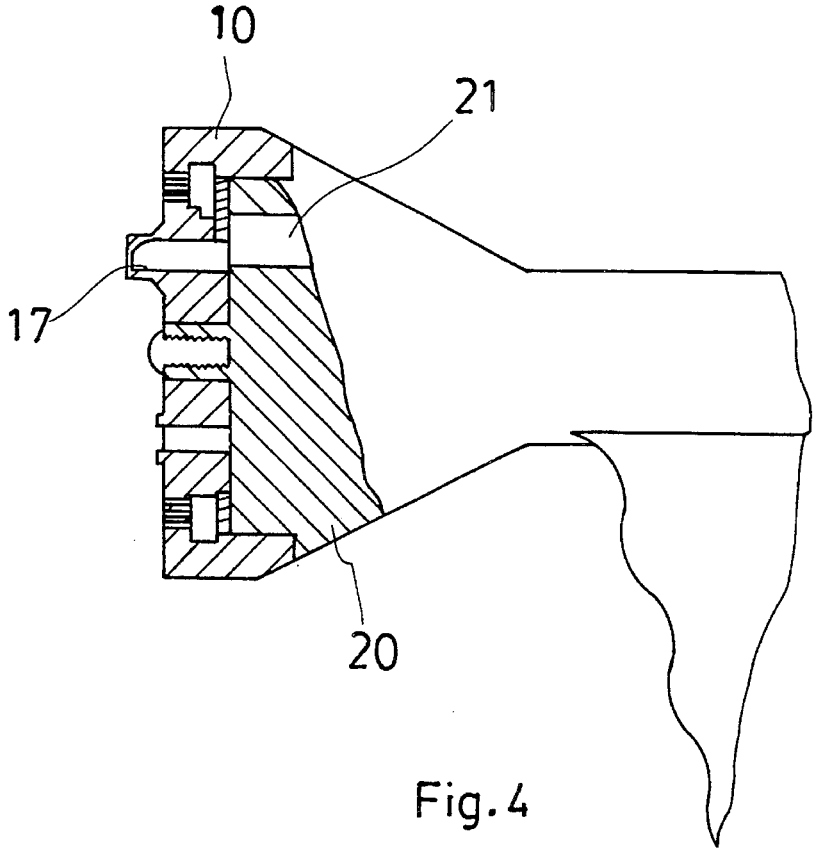
FIG. 4 is similar to FIG. 3 but showing the water outlet of the housing moved away from the through hole on the packing ring.

Referring to FIGS. 2 and 3, a water spray gun in accordance with the present invention is generally comprised of a housing 20, a spray-pattern dial 10 mounted on the housing 20 at the front, and a control lever 23 for controlling the drawing of water out of the housing 20 through the spray-pattern dial 10 and a water outlet 21 on the housing 20. The spray-pattern dial 10 is shaped like a hollow, rounded cup comprising an annular recess 12 on the inside around the border, a plurality of small through holes 13 through an annular recessed wall 12, a radial opening 11 disposed inwardly of in communication with the annular recessed wall 12. A groove 14 spaced inwardly of the annular recessed wall 12 and extending around opening 11, a packing ring 15 mounted around the annular opening 14 and having an inside projection with a through hole 16 disposed in the radial groove 11, and a plurality of nozzles 17. The nozzles 17 and the through hole 16 are arranged along the periphery of a circle so that they can be alternatively aligned with the water outlet 21 on the housing 20. When the through hole 16 on the packing ring 15 is set in alignment with the water outlet 21 of the housing 20, water can be driven out of the housing 20 through the through holes 13 on the annular recessed wall 12 (see FIG. 3). The nozzles 17 of the spray-pattern dial 10 include one having a 45° sector-like through hole 30 (see FIG. 2A) having a cross-sectional configuration defined by a 45° angle 32 formed by a pair of radii 33 and an arc section 34. When the 45° sector-like through hole is disposed in alignment with the water outlet 21 of the housing 20, the arc section 34 is disposed at the bottom and the angle 32 is disposed at the top in a vertical alignment when the spray gun is held in a normal horizontal position of use. This arrangement of 45° sector-like through hole allows the user to keep the water spray gun in a normal horizontal position of use and without requiring the front end of housing 20 to be turned down from the horizontal position while watering plants.

Referring to FIG. 2 again, the locking device 24 which can be operated to keep the control lever 23 pressed (i.e. to keep water flow continuously out of the housing 20) comprises a top projection 25 and two opposite side projections 26. When pressing the control lever 23 with the hand, either side projection 26 can be simultaneously depressed by the thumb, thereby causing the control lever 23 to be locked in the depressed position by the locking device 24.

Figure 5:
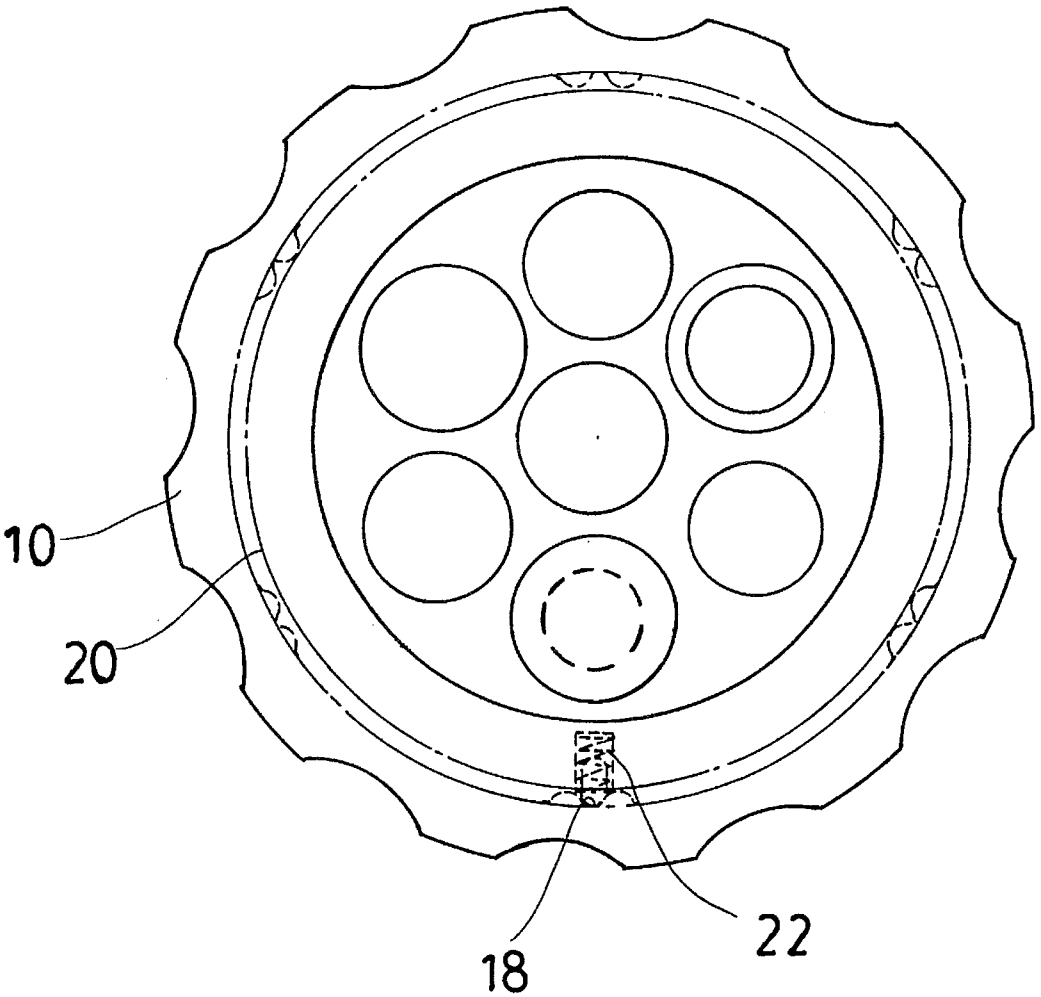
FIG. 5 is a front view of the water spray gun of the present invention, showing the spray-pattern dial retained to the housing by a spring-supported locating rod.

Referring to FIG. 5 and FIG. 2 again, the housing 20 has a recessed hole 27 on the periphery opposing the water outlet 21. A spring-supported locating rod 22 is received in the recessed hole 27 and partially extend out of the housing 20. The spray-pattern dial 10 has a plurality of vertical locating grooves 18 spaced around the inside wall. When either nozzle 17 or the through hole 16 is set in alignment with the water outlet 21 of the housing 20, the spring-supported locating rod 22 engages the corresponding vertical locating groove 18 to hold the spray-pattern dial 10 in position. Therefore, the spray-pattern dial 10 does not displace during the operation of the water spray gun.

I claim:

1. A water spray gun comprising:

a) a housing including a front water outlet and a control lever for controlling the flow of water through the water outlet;

b) a spray pattern dial rotatably mounted over the water outlet, the dial including a plurality of nozzles for selective alignment with the water outlet upon rotation of the dial, and an annular recess including a bottom wall extending around the nozzles, a plurality of holes extending around and through the bottom wall, and a radial opening disposed inwardly of the recessed wall;

c) a packing ring mounted within the annular recess, the ring including an inwardly extending projection fitted into the radial opening, the projection having a through hole for providing communication between the water outlet and the plurality of holes in the bottom wall of the annular recess through the radial opening when the projection is aligned with the water outlet;

d) at least one nozzle having a flow hole with a cross-sectional configuration in the form of a sector defined by an angle formed by a pair of radii and a peripheral arc, whereby when the at least one nozzle is aligned with the water outlet and the spray gun is maintained in a horizontal position of use, the angle is disposed above the peripheral arc in vertical alignment;

e) a plurality of locating grooves spaced around the annular recess and a locating means alternatively engageable with the locating grooves for selectively maintaining a nozzle or the projection in alignment with the water outlet; and f) locking means for maintaining the control lever in an open position for permitting continuous water flow through the water outlet.

2. The water spray gun of claim 1 wherein the angle of the sector is 45°.

3. The water spray gun of claim 1 wherein the locating means includes a recessed hole extending radially of the housing and a spring-supported locating rod extending out of the recessed hole.

4. The water spray gun of claim 1 wherein the locking means includes a top projection for locking the control lever in the depressed position and a pair of opposed side projections for engagement by a user to move the top projection into a locking position.

* * * * *